US007775612B2

(12) United States Patent
Ruan et al.

(10) Patent No.: US 7,775,612 B2
(45) Date of Patent: Aug. 17, 2010

(54) INTERLOCKING DEVICE FOR A DRAWER SLIDE

(75) Inventors: Teng Yi Ruan, Wuci Township, Taichung County (TW); Joe Lee, Wuci Township, Taichung County (TW)

(73) Assignee: Sun Chain Metal Industry Co., Ltd., Taipei (TW)

( * ) Notice: Subject to any disclaimer, the term of this patent is extended or adjusted under 35 U.S.C. 154(b) by 572 days.

(21) Appl. No.: 11/759,226

(22) Filed: Jun. 7, 2007

(65) Prior Publication Data

US 2008/0074017 A1 Mar. 27, 2008

(30) Foreign Application Priority Data

Sep. 21, 2006 (TW) ..... 95135003 A

(51) Int. Cl.
*E05B 65/46* (2006.01)

(52) U.S. Cl. ..... 312/221

(58) Field of Classification Search ..... 312/216, 312/217, 218, 219, 220, 221, 107.5, 222
See application file for complete search history.

(56) References Cited

U.S. PATENT DOCUMENTS

| | | | | |
|---|---|---|---|---|
| 4,768,844 | A * | 9/1988 | Ludwig | 312/221 |
| 5,050,942 | A * | 9/1991 | Frederick et al. | 312/221 |
| 5,335,986 | A * | 8/1994 | Hartrum et al. | 312/220 |
| 2004/0036387 | A1 * | 2/2004 | Ludwig et al. | 312/221 |
| 2005/0179346 | A1 * | 8/2005 | Ludwig et al. | 312/221 |

* cited by examiner

*Primary Examiner*—James O Hansen
(74) *Attorney, Agent, or Firm*—Banger Shia

(57) ABSTRACT

An interlocking device for a drawer slide is disposed at the end of a drawer and comprises a positioning block disposed at the end of the fixed slide rail, at least one moveable slide rail received in the fixed slide rail, a control block assembly, a first locking member, a second locking member, a pivot control member and a spring. The first and second locking members are pushed to clamp the pivot control member by the spring. The control block of the control block assembly is fixed at the end of the moveable slide rail. The drawer is used to move a control block on the slide rail, and then the guiding portion and the pushing block of the control block can push the pivot control member to move. Therefore, the interlocking device for a drawer slide is simple.

6 Claims, 12 Drawing Sheets

INTERLOCKING DEVICE FOR A DRAWER SLIDE

BACKGROUND OF THE INVENTION

1. Field of the Invention

The present invention relates to an interlocking device for a drawer slide, and more particularly to an equipment disposed at the end of the drawer slide, which facilitates the interlocking of the interlocking device and simples the interlocking structure.

2. Description of the Prior Art

The pull and push design between a drawer and a cabinet is two opposite slide rails that are slideably mounted to each other for enabling the drawer to be movably disposed in the cabinet, and through the slide rails, the drawer can be pushed into or pulled out of the cabinet.

With the time advances, the current drawer slide is further provided on the two slide rails with a stopping member, such as a protruding portion or a protruding block, which prevents the drawer from disengaging from and falling out of the cabinet when it is pushed. The drawer is normally defined with a relatively long longitudinal space for increasing the store capacity. For easy access to the articles inside the drawer, the drawer slide must be designed to allow the drawer to move a relatively long length without disengaging from the slide rails, so that the drawer can be pulled out without falling off the cabinet.

However, a cabinet is usually provided with a plurality of drawers arranged vertically, and after being loaded with articles, each drawer becomes a heavy unit. The slide rails make it easier to pull and push the drawers, and the drawers can be pulled out completely, however, if the cabinet is accidentally inclined by improper use or external factors, such as earthquake, several drawers of the cabinet will be pulled out simultaneously. At this moment, the position of center of the gravity of the cabinet will shift, as a result, the cabinet is likely to fall down to hurt the user or damage the articles inside the cabinet. To solve this potential danger, currently EU stipulates that the plural longitudinal drawers of a cabinet must be provided with an interlocking device to prevent the drawers from being pulled out simultaneously when the cabinet is inclined.

To prevent too many drawers from being pulled out and cause the fall-down of the cabinet, it must ensure that only one drawer can be pulled out at a time. Therefore, an interlinkage device appears on the market and is disposed at the end of the respective slide rails. If one of the drawer slides is pulled, it will use many complicated subassemblies to trigger a connecting rod of the interlinkage device that is disposed between the respective slide rails to prevent other drawer slides from being pulled out. However, this conventional design is very complicated in structure and expensive.

FIG. 1 shows another conventional interlocking device that comprises a plurality of drawer slides 30, a first actuator 31, a second actuator 32, a shaft 33, a locking unit 34, and a transmission unit 35. Each of the drawer slides 30 includes a fixed slide rail 36 and a movable slide rail 37. The first actuator 31 is rotatably and pivotally disposed at the front end of the respective moveable slide rails. The second actuator 32 is fixed at the front end of the respective fixed slide rails 36 and includes a pair of bases 38 and a pair of transmission members 39 on the bases 38. One end of the each transmission member 39 contacts the first actuator 31, the shaft 33 is located between the respective drawer slides 30 in such a manner that both ends of the shaft 33 are connected to the transmission members 39, with the action of the transmission members, the movable slide rail of the drawer slide 30 can move out of the fixed slide rail. The first actuator 31 drives the respective transmission members 39 of the second actuator 32 and the shaft 33 to move back and forth repeatedly, and then the respective transmission members are engaged with and stopped by the locking unit, thus preventing the disengagement of the drawer slide from the fixed slide rail.

Although the second conventional structure has been improved a lot, it still has too many components and its manufacturing and assembling process is still complicated.

The present invention has arisen to mitigate and/or obviate the afore-described disadvantages.

SUMMARY OF THE INVENTION

The primary objective of the present invention is to provide a simply structured interlocking device for a drawer slide, and the secondary objective of the present invention is to provide a low cost and low price interlocking device for a drawer slide.

To achieve the two above objectives, an interlocking device for a drawer slide in accordance with the present invention comprises: a fixed slide rail, at least one movable slide rail, a positioning block, a first locking member, a second locking member, a pivot control member, at least one spring, a control block assembly and two connecting rods. The control block of the control block assembly is fixed at one end of the fixed slide rail. The pivot control member the first locking member and the second locking member are mounted on the positioning block. The first and second locking members are pushed to clamp the pivot control member by the spring. The present invention uses the drawer to move a control block on the slide rail, and then the guiding portion and the pushing block of the control block can push the pivot control member to move, so that the first and second locking members of the interlocking device of the respective drawers are interlocked. Therefore, the structure of the present invention is simple.

The control block of the control block assembly is pivotally disposed at the end of the slide groove by the elastic return member. The action of swinging and returning to start position of the control block can make the pivot control member return from disengagement status to engagement status by cooperating with the guiding portion and the pushing block. And then pivot control member can be controlled again, therefore, the function of the interlocking device will not be affected when the pivot control member falls off.

It is noted that the guiding portion of the control block moves the pivot control member, and the guiding portion can be a L-shaped guiding slot or guiding surface. The L-shaped guiding slot is formed in the control block and extends backward from the front end of the control block to form a L shape. The guiding surface is defined on the top of the control block for pushing the slant guiding surface of the pivot control member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
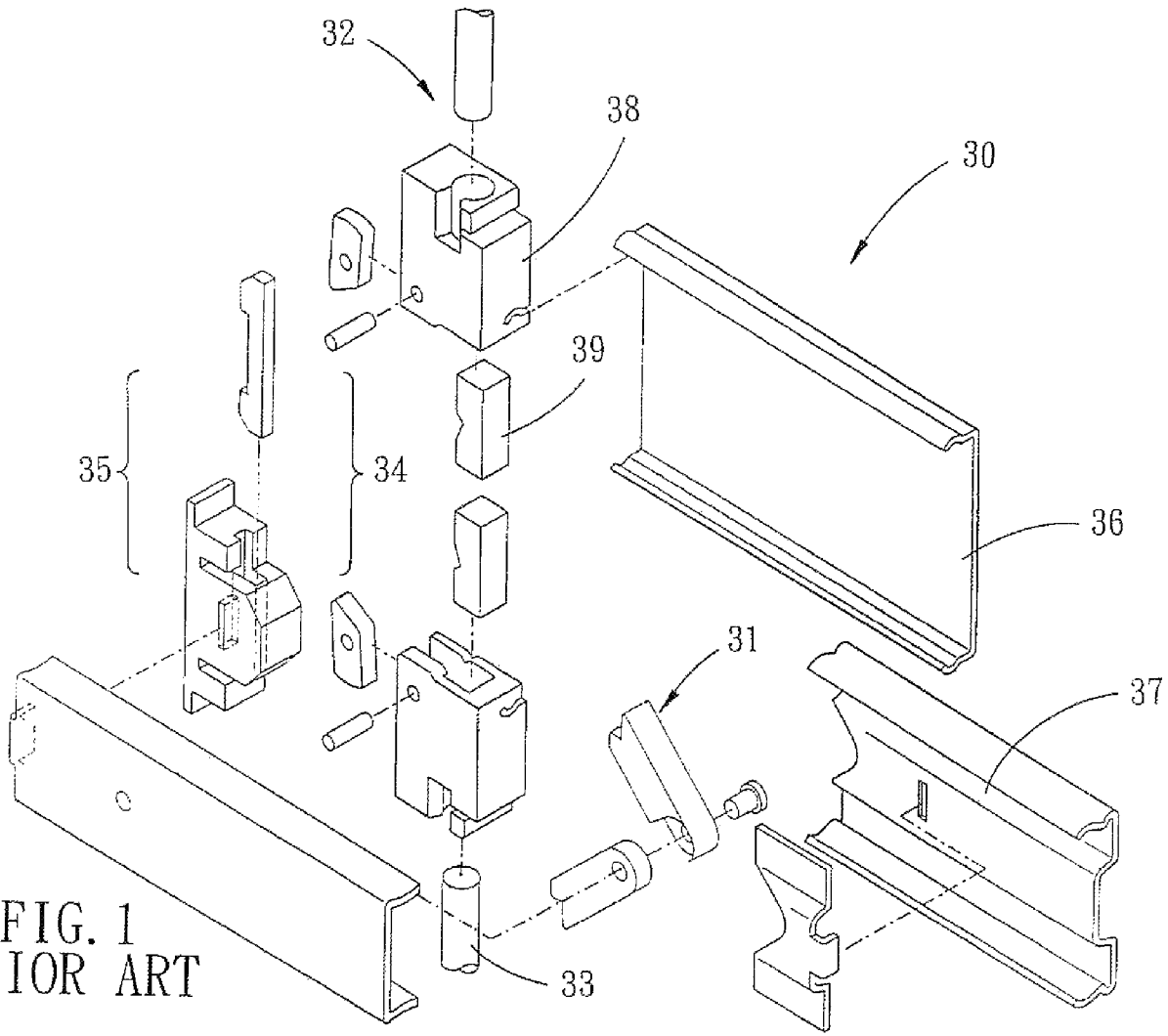
FIG. 1 PRIOR ART
FIG. 1 is an exploded view of a conventional interlocking device for a drawer slide.
Figure 2:
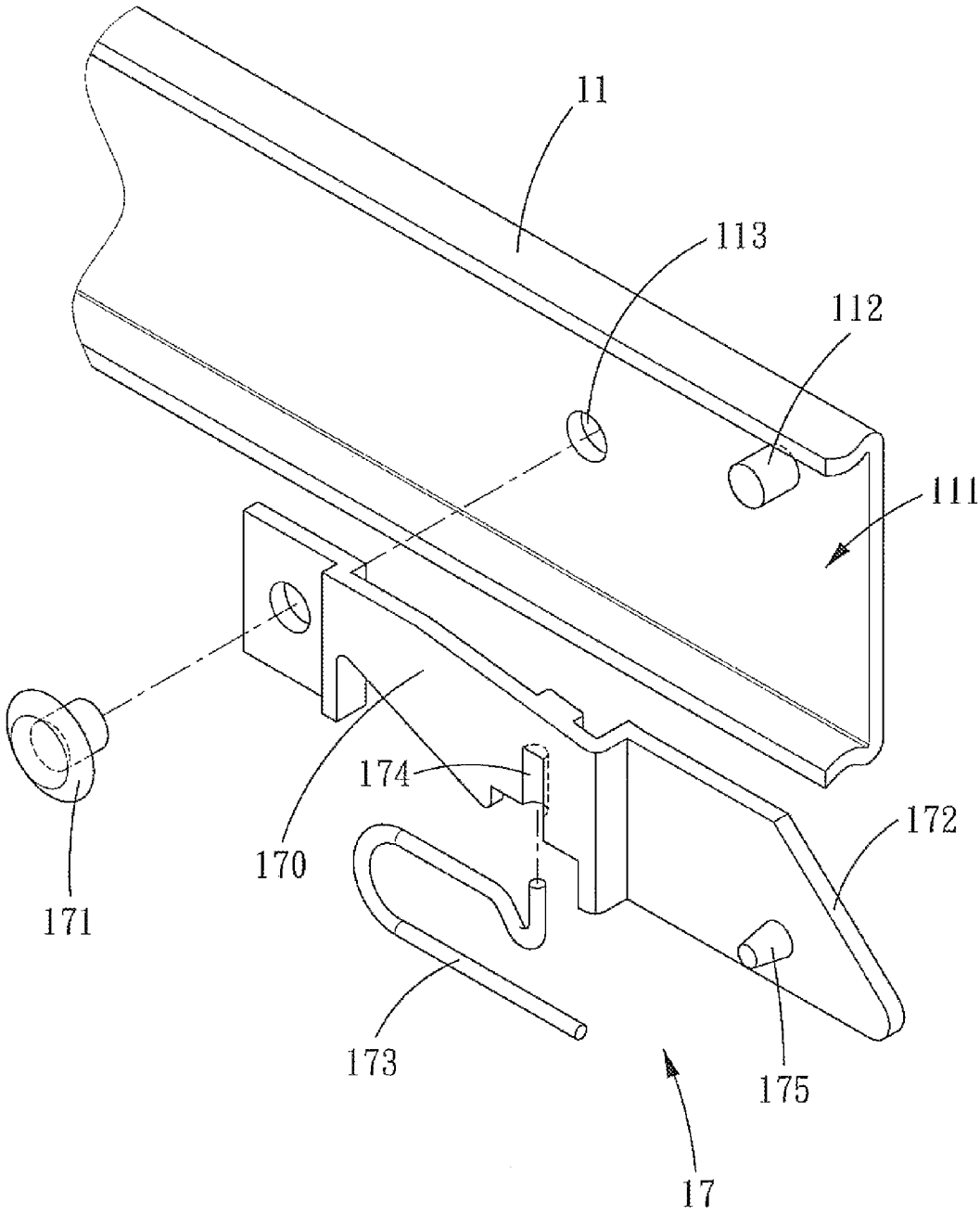
FIG. 2 is an exploded view of a control block assembly in accordance with the present invention.
Figure 3:
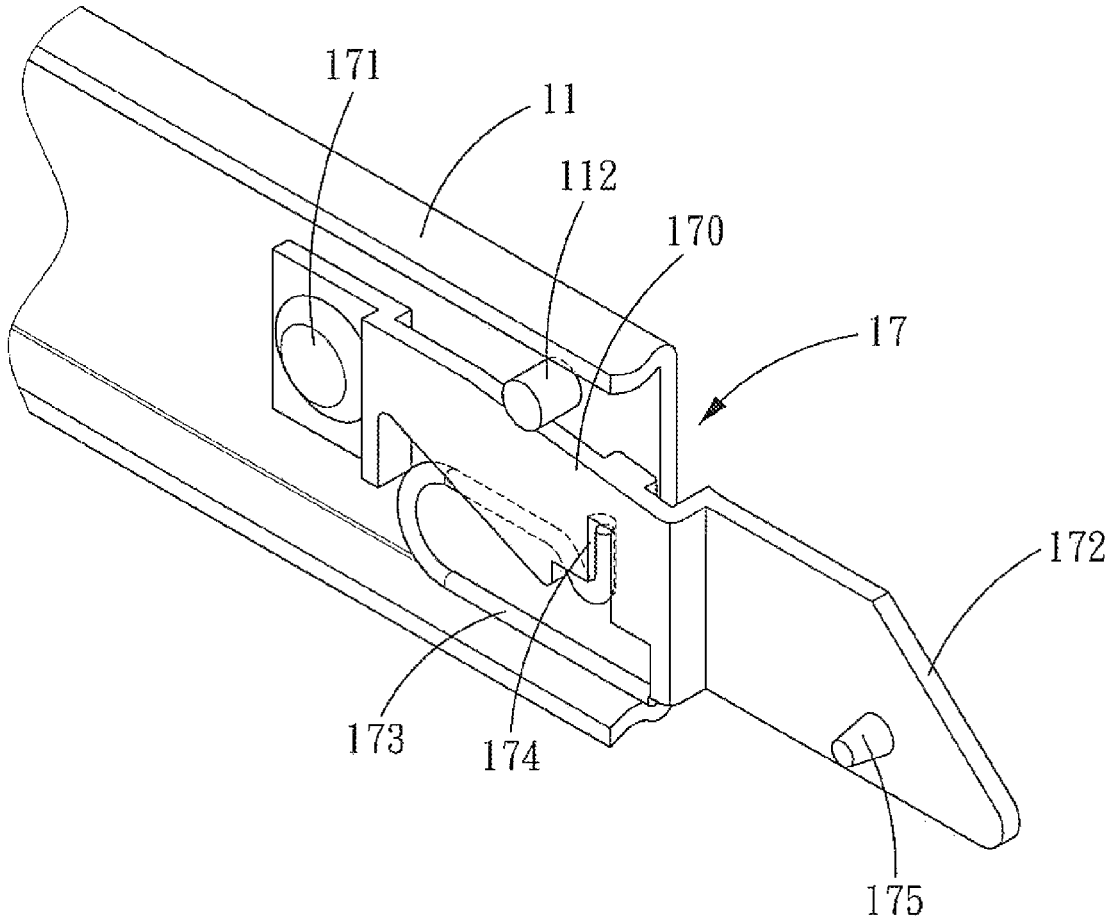
FIG. 3 is an assembly view of the control block assembly in accordance with the present invention.
Figure 4:
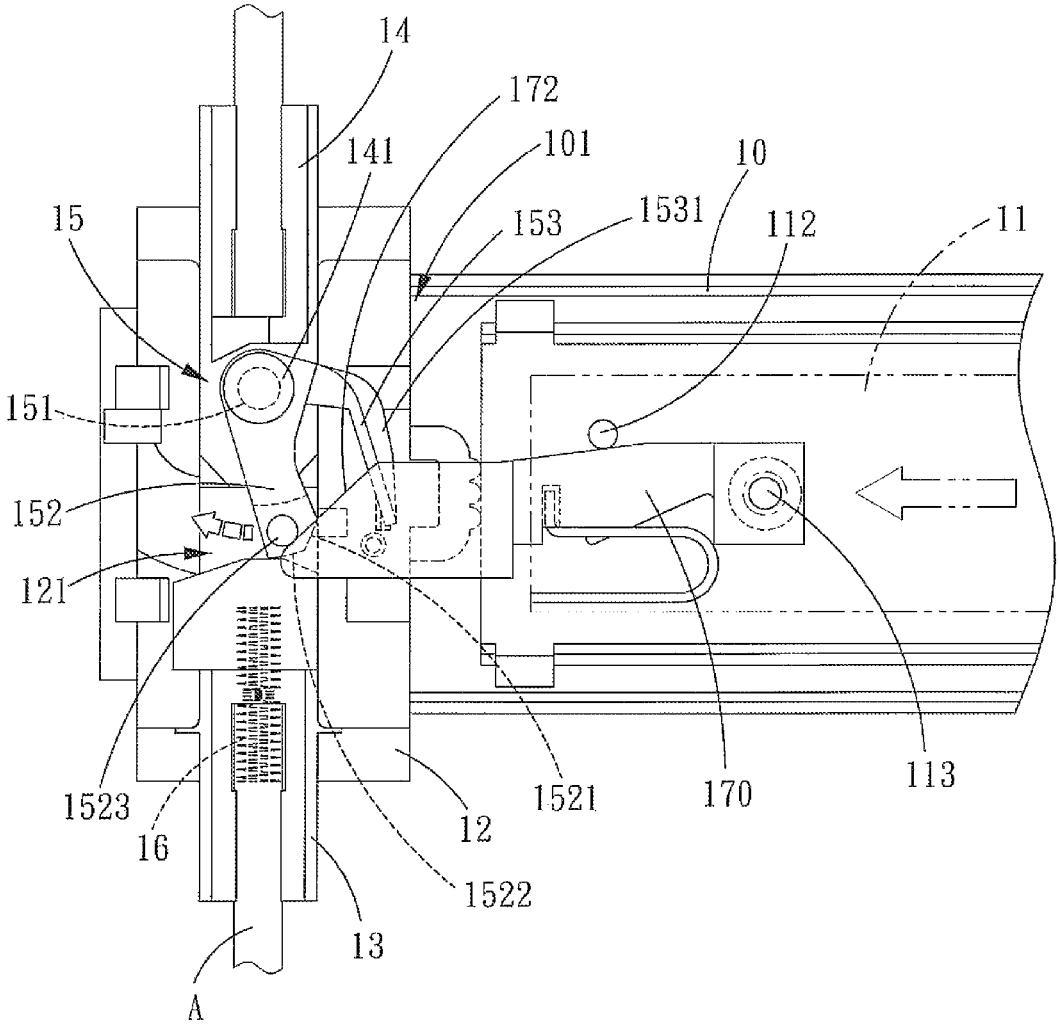
FIG. 4 is a perspective view in accordance with the present invention of showing the normal closed status of the interlocking device for a drawer.

Referring to FIGS. 2-4, an interlocking device for a drawer slide in accordance with the present invention comprises: a fixed slide rail 10, at least one movable slide rail 11, a positioning block 12, a first locking member 13, a second locking member 14, a pivot control member 15, a spring 16, a control block assembly 17 and a plurality of connecting rods A. The interlocking device is disposed between the drawer and the surface of the cabinet. The first and second locking members 13, 14 are the same as the conventional structure in terms of design and technique; therefore, further explanations are omitted.

The fixed slide rail 10 is fixed to the surface of the cabinet and is provided with a receiving seat 101 on the drawer-receiving side thereof for receiving the drawer.

The movable slide rail 11 is movably disposed in the fixed rail 10 and is defined with a receiving groove 111 for receiving the receiving seat 101. At the end of the receiving groove 111 are formed a stopping member 112 and a pivot hole 113.

The positioning block 12 is positioned in the receiving seat 101 of the fixed slide rail 10 and is provided with a slide groove 121 perpendicular to the horizontal direction.

The first locking member 13 and the second locking member 14 are slideably disposed at both ends of the slide groove 121 of the positioning block 12, and at the end of the second locking member 14 is disposed a pivot member 141.

The pivot control member 15 is a V-shaped board located between the first and second locking members 13, 14 and is pivotally mounted on the pivot member 141 of the second locking member 14 through a pivot hole 151. A guiding block 152 is formed on the pivot control member 15 for cooperating with the first locking member 13 and includes a slant surface 1521, a flat surface 1522, and a control shaft 1523 on the surface of the guiding block 152. The pivot control member 15 is further provided with a confirmation rod 153 located at another extending end thereof facing the pulling-out direction of the drawer. A slant surface 1531 is formed on a side of the confirmation rod 153 and located in the direction of the movable slide rail 11.

The spring 16 is disposed in a groove of the first locking member 13 and biased between the first locking member 13 and the positioning block 12 for pushing the first locking member 13 toward the second locking member 14.

The control block assembly 17 includes a control block 170, a pivot shaft 171, and an elastic return member 173. One end of the control block 170 protrudes out of the end of the movable slide rail 11 and is fixed to the pivot hole 113 of the receiving groove 111 of the movable slide rail 11 by the pivot shaft 171. The control block 170 is provided with a slant guiding surface 172 (one of the embodiments of the guiding portion of the present invention) at the front edge thereof for cooperating with the control shaft 1523 of the pivot control member 15. The elastic return member 173 is positioned between a positioning groove 174 of the control block and the inner surface of the receiving groove 111 of the movable slide rail 11. A pushing block 175 is formed on the control block 170 for cooperating with the confirmation rod 153 of the control pivot member 15 and is located opposite the slant surface 1531 of the confirmation rod 153. The control block 170 is pushed against the stopping member 112 of the slide rail 11 by the elastic return member 173.

Figure 5:
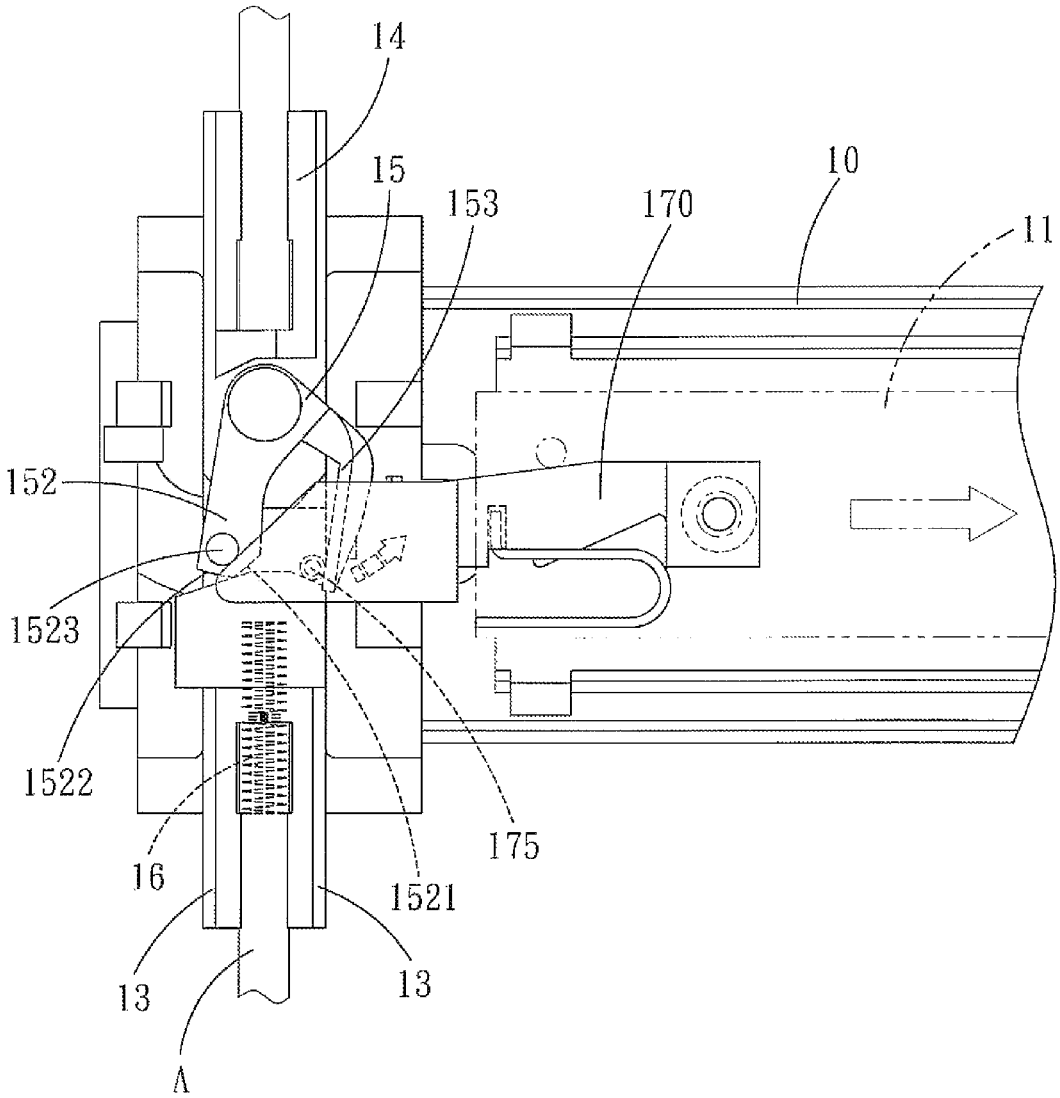
FIG. 5 is a perspective view in accordance with the present invention of showing the normal pulling-out status of the interlocking device for a drawer.

For a better understanding of the present invention, its operation and function, reference should be made to FIGS. 4 and 5.

The interlocking device for a drawer slide in accordance with the present invention is fixed on each of the drawers, and the interlocking device of the respective drawers utilizes the connecting rod A to connect the first and second locking members 13, 14.

In the normal state, the pivot control member 15 uses its flat surface 1522 to push the first locking member 13, enabling the first and second locking members 13, 14 to be slideably positioned in the pulling-out position, and the spring 16 is compressed. When closing the drawer, the control block 170 uses its guiding surface 172 to push the control shaft 1523 of the pivot control member 15, making the pivot control member 15 rotate outward, as shown in FIG. 4. The spring 16 pushes the first locking member 13 to move toward the second locking member 14, meanwhile the control shaft 1523 of the pivotal control member 15 is pushed by the spring 16 to move outward. At this moment, the respective drawers are positioned in the close position, and the connecting rod A of each of the drawers can be actuated to operate at any time.

When one of the drawers is pulled out, with reference to FIG. 5, the control block 170 slides outward along with the movable slide rail 11. At this moment, the confirmation rod 153 of the pivot control member 15 is pushed by the pushing block 175 of the control block 170 to rotate toward the pulling-out direction of the drawer. And after the slant surface 1521 of the guiding block 152 of the pivot control member 15 pushes the first locking member 13 to move outward, the flat surface 1522 will push against the first locking member 13, so that the first locking member 13 compresses the spring 16, and the first locking member 13 extends outward. At this moment, the second locking member 14 is also completely pushed outward and positioned at the other end, and the second locking member 14 is unable to move toward the first locking member 13 at this moment, leaving no space for the connecting rod A of any lower drawers to push upward. Therefore, the first locking member 13 of any other interlocking devices is unable to move outward (thus locking the other drawers).

FIGS. 4 and 5 show the normal operation state of the interlocking device for a drawer slide in accordance with the present invention.

Figure 6:
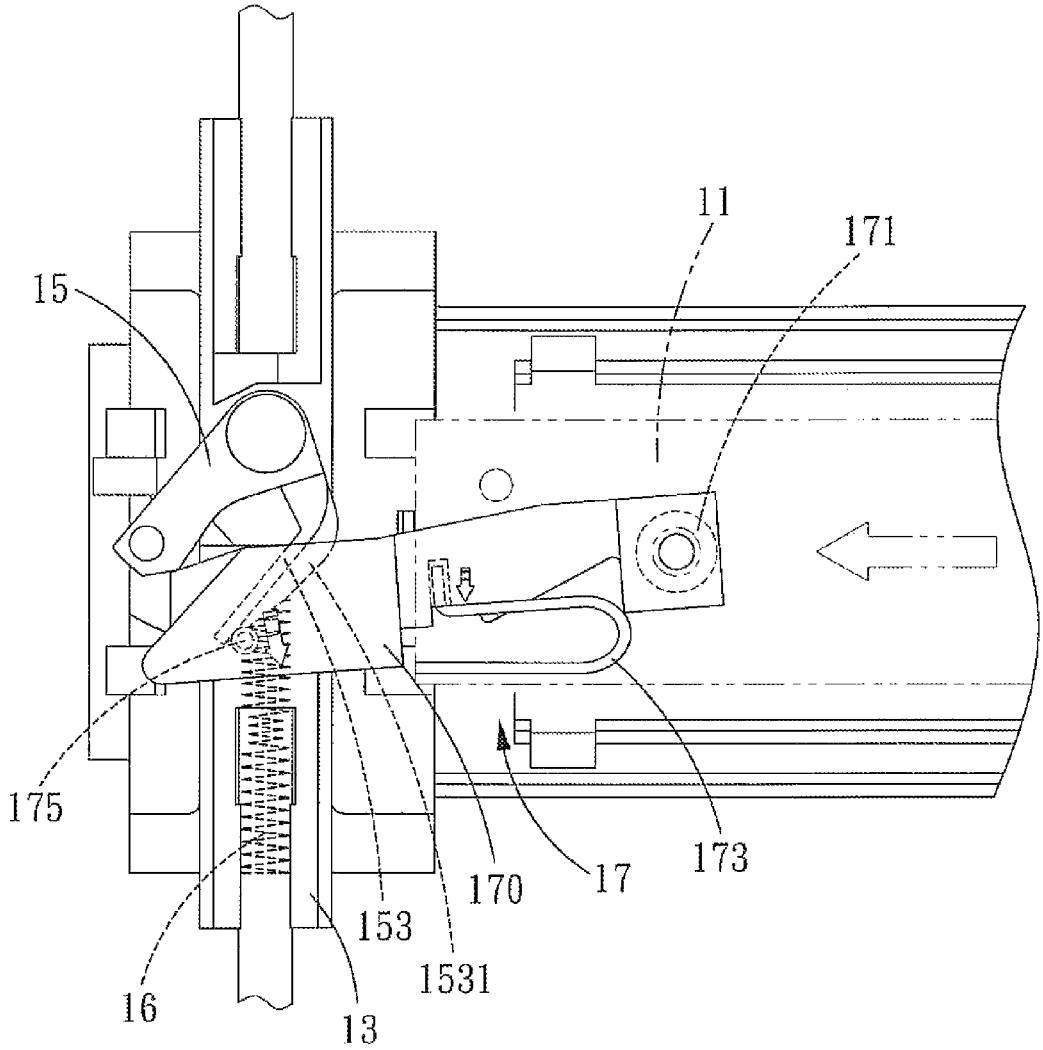
FIG. 6 is a perspective view in accordance with the present invention of showing the non-normal closed status of the interlocking device for a drawer.
Figure 7:
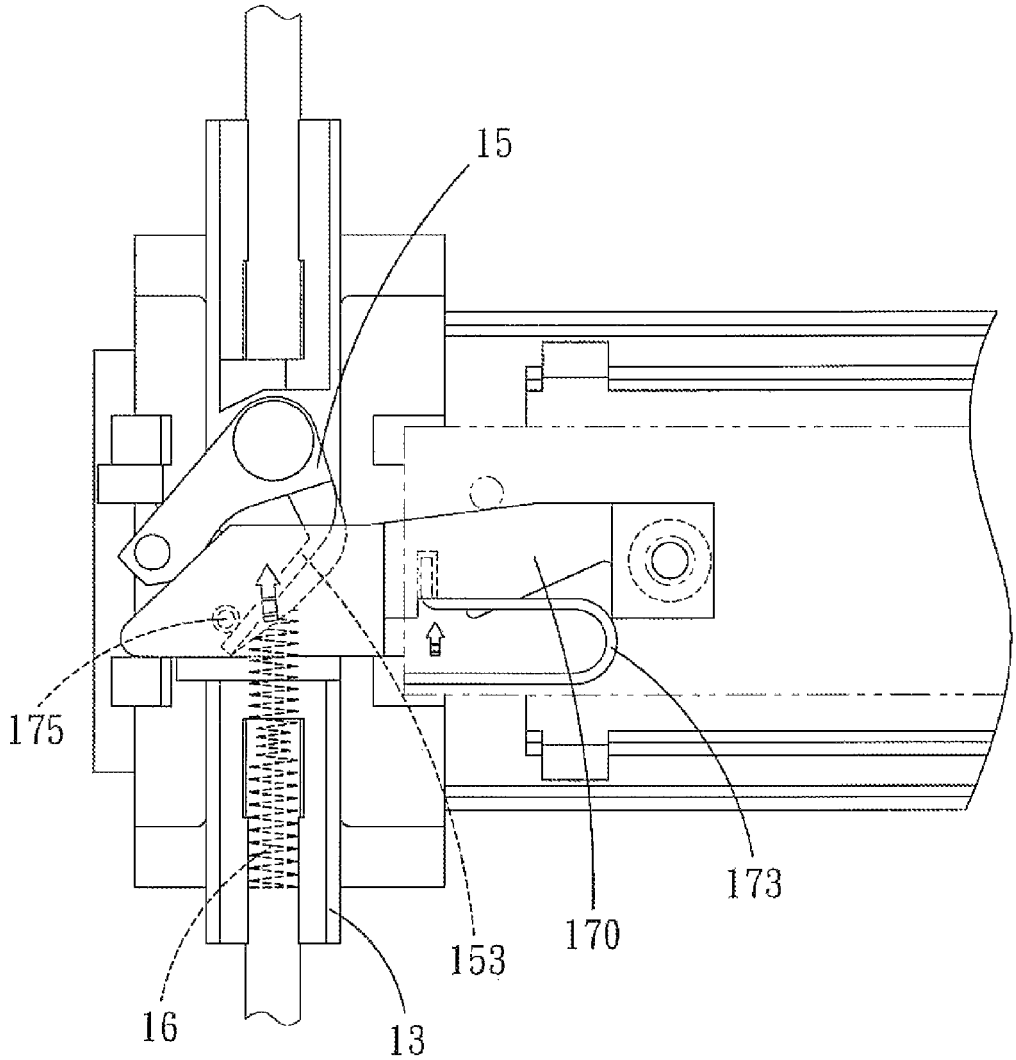
FIG. 7 is a perspective view in accordance with the present invention of showing the non-normal closed status of the interlocking device for a drawer.

And the non-normal operation state of the interlocking device for a drawer slide in accordance with the present invention is shown in FIGS. 6 and 7. When one of the drawers is pulled out, if the pivot control member 15 is pushed by the spring 16 to rotate outward automatically in the case of a shock or an improper operation, the operation of the interlocking device will be as follows:

The control block 170 of the control block assembly 17 can exert its function of swinging and returning to start position. When the user pushes the drawers into the cabinet (the movable drawer 11 is pushed inward), since the confirmation rod 153 of the pivot control member 15 will interfere with the pushing block 175 of the control block 170, so that the pushing block 175 of the control block 170 will slide smoothly along the slant surface 1531 of the confirmation rod 153, and the control block 170 will swing around the pivot shaft 171 to successfully surmount the confirmation rod 153, and meanwhile, the elastic return member 173 is fully compressed.

After the pushing block 175 of the control block 170 surmounts the confirmation rod 153, the elastic return member 173 will push the control block 170 back to the stopping member 112 of the movable slide rail 11. At this moment, the pushing block 175 of the control block 170 returns to the position at which to push the pivot control member 15, therefore, the function of the interlocking device will not be affected when the pivot control member 15 falls off.

Figure 8:
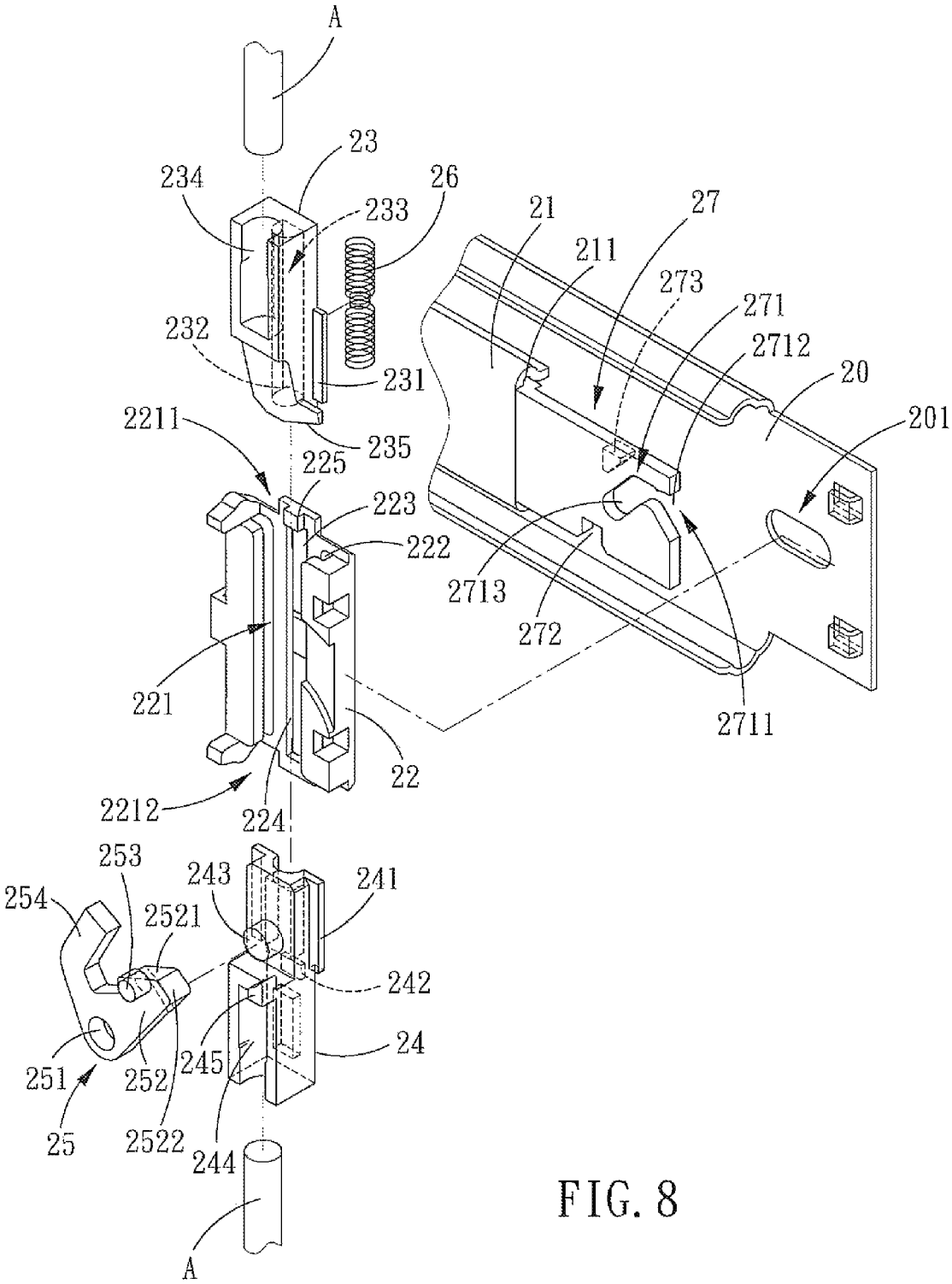
FIG. 8 is an exploded view of an interlocking device for a drawer slide in accordance with another embodiment of the present invention.
Figure 9:
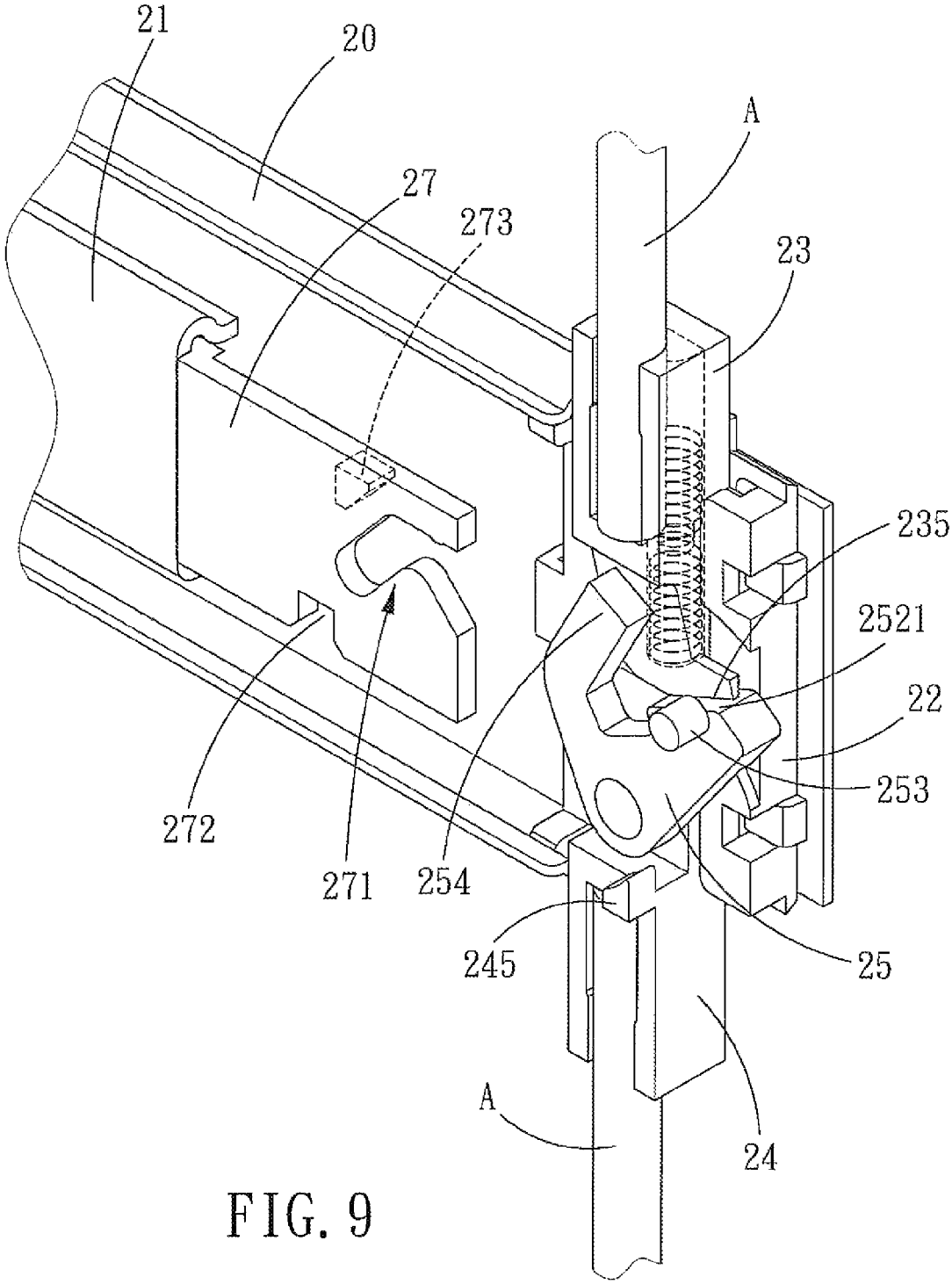
FIG. 9 is an assembly view of the interlocking device for a drawer slide in accordance with another embodiment of the present invention.

FIGS. 8 and 9 show another embodiment of the interlocking device for a drawer slide in accordance with the present invention, which comprises a fixed slide rail 20, at least one movable slide rail 21, a positioning block 22, a first locking member 23, a second locking member 24, a pivot control member 25, a spring 26, a control block 27 and a plurality of connecting rods A. The interlocking device is disposed between the drawer and the surface of the cabinet.

The fixed slide rail 20 is fixed to the surface of the cabinet and is provided with a receiving seat 201 on the drawer-facing side thereof for receiving the drawer.

The movable slide rail 21 is movably disposed in the fixed rail 20 and is defined with a receiving groove 211 for receiving the receiving seat 201.

The positioning block 22 is positioned in the receiving seat 201 of the fixed slide rail 20 and is provided with a slide groove 221 perpendicular to the horizontal direction. The slide groove 221 has a first open end 2211 and a second open end 2212. Parallel guiding grooves 222 are formed at both sides of the slide groove 221, and two parallel stopping grooves 223 and 224 are defined at the bottom of the first and second open ends 2211, 2212. And a protruding pushing member 225 is formed at the first open end 2211 and located close to the stopping groove 223.

The first locking member 23 is slideably disposed in the slide groove 221 of the positioning block 22 and has two lateral guiding pieces 231 slideably received in the parallel guiding grooves 222. A limiting protrusion 232 at the bottom of the first locking member 23 is inserted in the stopping groove 223 of the positioning block 22. A through groove 233 is defined in the first locking member 23 and is located correspondingly to the limiting protrusion 232 and the pushing member 225 of the positioning block 22. A fixing groove 234 is defined at one end of the first locking member 23 facing the first open end 2211 for accommodation of the connecting rod A, and a slant guiding surface 235 is formed at the other end of the first locking member 23 facing the second open end 2212 and extends outward therefrom.

The second locking member 24 is slideably received in the slide groove 221 of the positioning block 22 and has two lateral guiding pieces 241 slideably received in the parallel guiding grooves 222. A limiting protrusion 242 at the bottom of the second locking member 24 is inserted in the stopping groove 224 of the positioning block 22. A pivot member 243 is formed on the end of the second locking member 24 facing the first open end 2211, and a fixing groove 244 is formed at the other end of the second locking member 24 facing the second open end 2212 for accommodation of the connecting rods A. A protruding engaging member 245 is formed between the pivot member 243 and the fixing groove 244 of the second locking member 24. The engaging member 245 is a square-pillar-shaped structure and is located in the front edge of the second locking member 24 facing the sliding direction thereof.

The pivot control member 25 is a V-shaped board located between the first and second locking members 23, 24 and is pivotally mounted on the pivot member 243 of the second locking member 24 through a pivot hole 251. A guiding block 252 is formed on the pivot control member 25 for cooperating with the slant guiding surface 235 of the first locking member 23 and includes a slant surface 2521, a flat surface 2522, and a control shaft 253 on the surface of the guiding block 252. The pivot control member 25 is further provided with a confirmation rod 254 located at another extending end thereof facing the pulling-out direction of the drawer.

The spring 26 is disposed in the through groove 233 of the first locking member 23 and biased between the positioning protrusion 232 of the first locking member 23 and the pushing member 225 of the positioning block 22 for pushing the first locking member 23 toward the second open end 2212 of the positioning block 22.

The control block 27 is disposed in the receiving groove 211 of the moveable slide rail 21 and is defined with a L-shaped guiding slot 271 (one of the embodiments of the guiding portion of the present invention) for cooperating with the control shaft 253 of the pivot control member 25. The L-shaped guiding slot 271 is formed at the front portion of the control block 27 and includes an open end 2711, a release portion 2712 and a pulling and engaging portion 2713. The control block 27 is defined with an engaging slot 272 located correspondingly to the engaging member 245 of the second locking member 24 and further provided with a pushing block 273 for pushing the confirmation rod 254 of the pivot control member 25, and the pushing block 273 is formed opposite the L-shaped guiding slot 271 and located in the pulling-out direction of the drawer.

Figure 10:
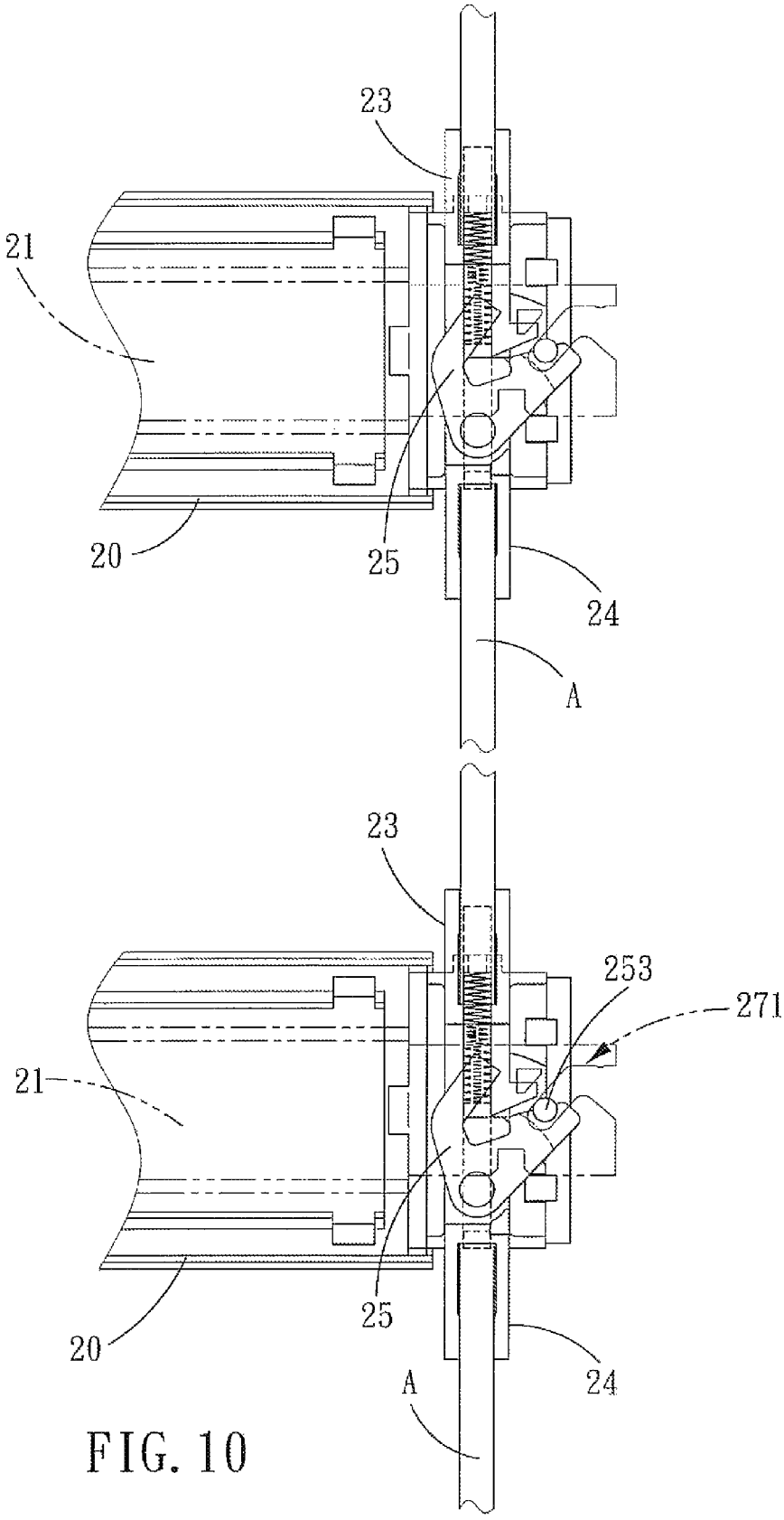
FIG. 10 is a perspective view in accordance with another embodiment of the present invention of showing the closed status of the interlocking device for a drawer.
Figure 11:
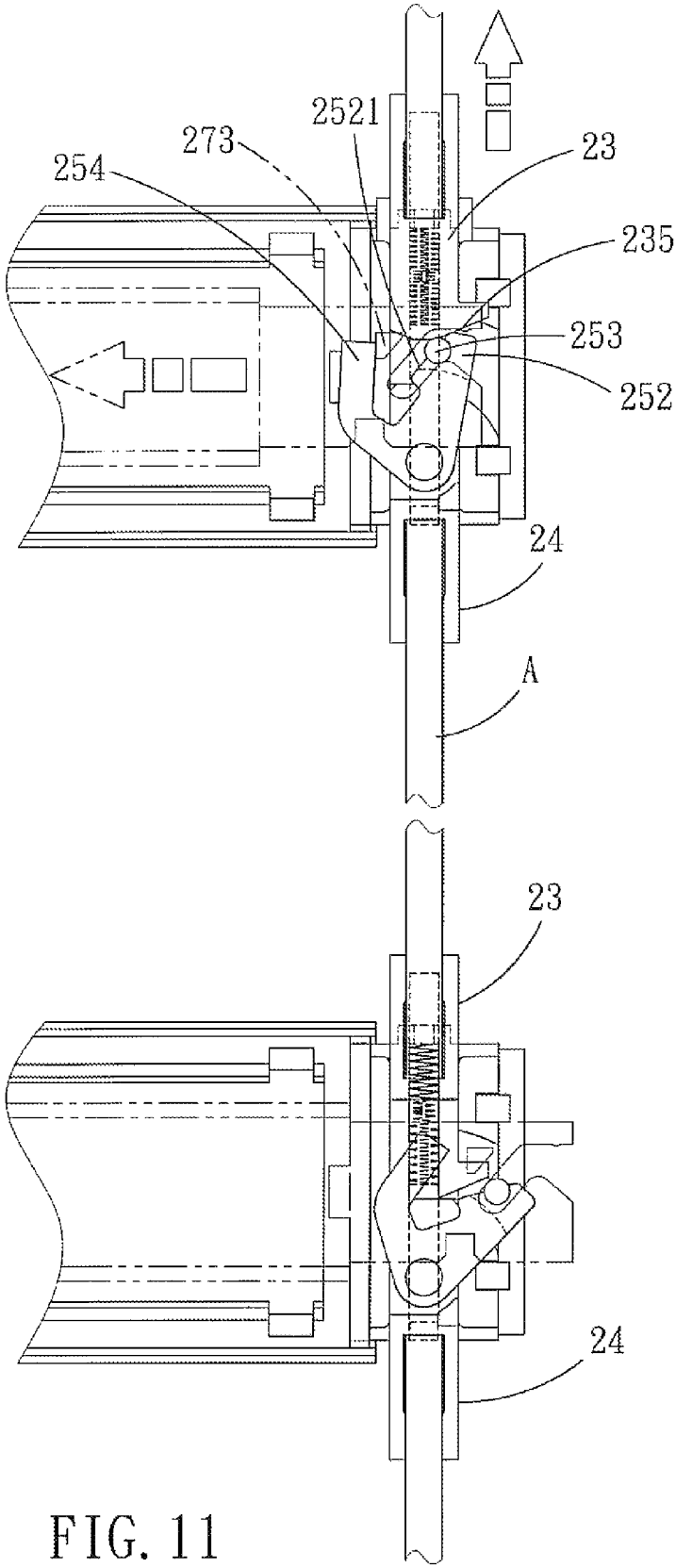
FIG. 11 is a perspective view in accordance with another embodiment of the present invention of showing the interlocking device when the upper drawer is pulled out.
Figure 12:
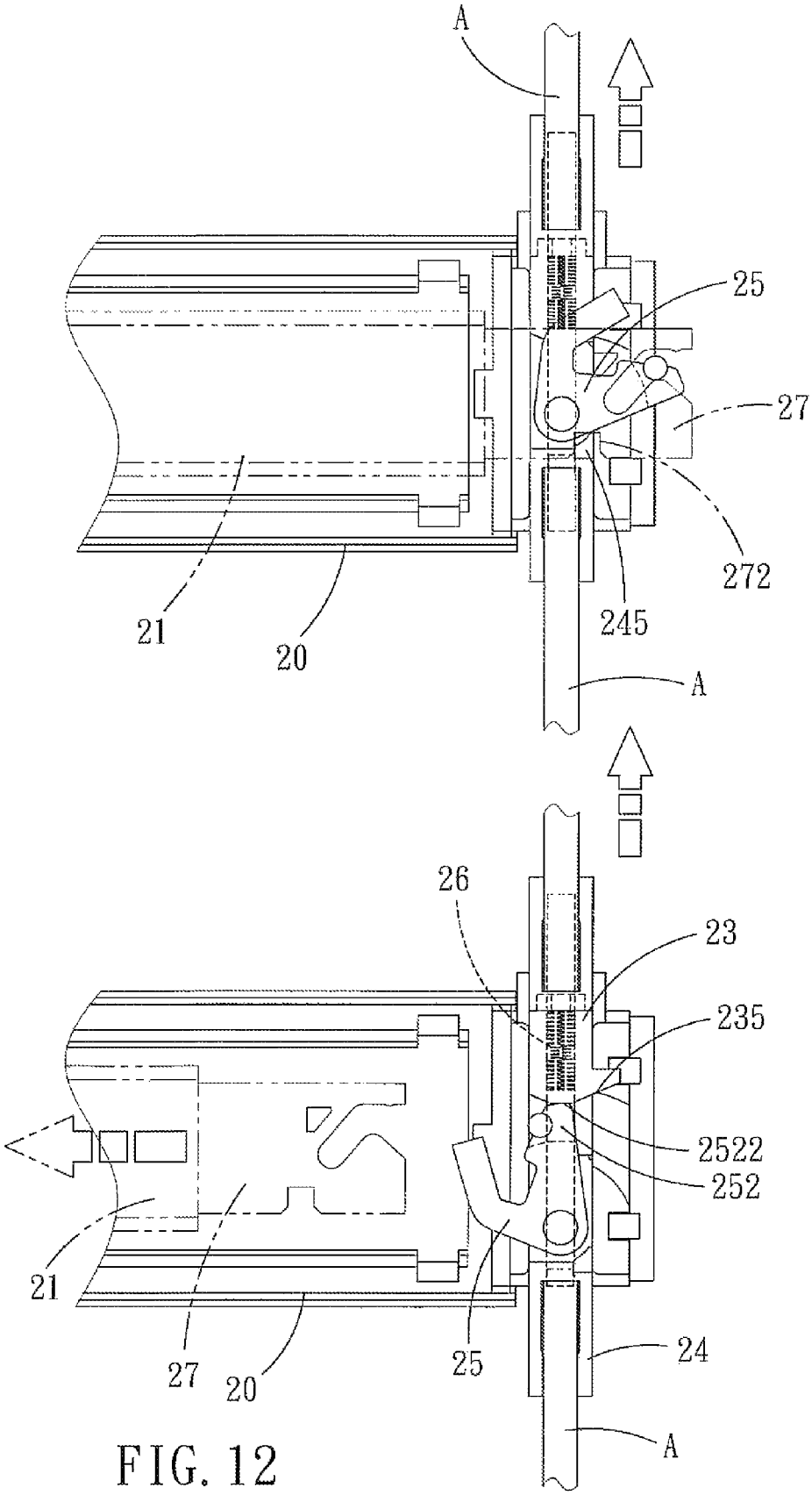
FIG. 12 is a perspective view in accordance with another embodiment of the present invention of showing the interlocking device when the lower drawer is pulled out.

For a better understanding of the present invention, its operation and function, reference should be made to FIGS. 10, 11 and 12.

The interlocking device for a drawer slide in accordance with the present invention is fixed on each of the drawers, and the interlocking device of the respective drawers utilizes the connecting rod A to connect the first and second locking members 23, 24.

When all the drawers are closed, as shown in FIG. 10, the first and second locking members 23, 24 are slideably disposed in the slide groove 221 of the positioning block 22. The spring 26 is received in the through groove 233 of the first locking member 23 for pushing the limiting protrusion 232 of the first locking member 23 and making the first locking member move close to the second locking member 24. The spring 26 will push the control shaft 253 of the pivot control member 25 to the pulling and engaging portion 2713 of the L-shaped guiding slot 271 of the control block 27, at this moment, the respective drawers are in the closed position, and each of the drawers can be actuated to operate at any time.

When an upper drawer is pulled out, as shown in FIG. 11, the control block 27 moves outward along with the movable slide rail 21. At this moment, the control shaft 253 of the pivot control member 25 will be pulled by the L-shaped guiding slot 271 of the control block 27, so that the pivot control member 25 will rotate in the pulling-out direction of the direction, and the control shaft 253 will disengage from the release portion 2712 of the L-shaped guiding slot 271. And then, the guiding block 252 of the pivot control member 25 will use the flat surface 2522 to push the slant guiding surface 235 of the first locking member 23, and as a result, the spring 26 is compressed by the limiting protrusion 232 of the first locking member 23, and the first locking member 23 extends outward. At this moment, the second locking member is also completely pushed outward and positioned at the other end, and the second locking member 14 is unable to move toward the first locking member at this moment, leaving no space for the connecting rod A of any lower drawers to push upward. Therefore, the first locking member of any other interlocking devices is unable to move outward (thus locking the lower drawers).

It is noted that the pivot control member 25 is a V-shaped board and is provided with a confirmation rod 254 located at another extending end thereof facing the pulling-out direction of the drawer. Before the control shaft 253 of the pivot control member 25 is pulled to the optimum positioning position by the L-shaped guiding slot 271 of the control block 27, the pushing block 273 of the control block 27 will push the confirmation rod 254 of the pivot control member 25 in the pulling-out direction to the positioning position, so that the first locking member 23 extends outward to its positioning position, and meanwhile, the spring 26 also pushes the pivot control member 25 to its positioning position.

When a lower drawer is pulled out, as shown in FIG. 12, the control block 27 moves outward along with the movable slide rail 21. At this moment, the control shaft 253 of the pivot control member 25 will be pulled by the L-shaped guiding slot 271 of the control block 27 so that the pivot control member 25 will rotate in the pulling-out direction of the direction, making the first locking member 23 extend outward, and the control shaft 253 will disengage from the release portion 2712 of the L-shaped guiding slot 271. And then, the guiding block 252 of the pivot control member 25 will use the flat surface 2522 to push the slant guiding surface 235 of the first locking member 23, and as a results the spring 26 is compressed by the limiting protrusion 232 of the first locking member 23, and the first locking member 23 extends outward. At this moment, the outward extending first locking member 23 will drive the connecting rod A to push the interlocking device of the upper drawer, making the engaging member 245 of the second locking member 24 of the interlocking device of the upper drawer slide into the engaging slot 272 of the control block 27 (thus locking the upper drawers).

It is important that the present invention is simple in structure and uses the drawer to move a control block on the slide rail, and then the guiding portion (the L-shaped guiding slot or the slant guiding surface) and the pushing block of the control block can push the pivot control member to move, so that the first and second locking members of the interlocking device of the respective drawers are interlocked. Therefore, the present invention has fewer components than the conventional structure and simple.

While we have shown and described various embodiments in accordance with the present invention, it is clear to those skilled in the art that further embodiments may be made without departing from the scope of the present invention.

What is claimed is:

1. An interlocking device for a drawer slide comprising:

a fixed slide rail, at least one movable slide rail, a positioning block, a first locking member, a second locking member, a pivot control member, at least one spring, a control block assembly and two connecting rods; wherein the moveable slide rail is movably disposed in the fixed slide rail;

the positioning block is fixed at one end of the fixed slide rail and is defined with a slide groove;

the first locking member is slideably disposed in the slide groove of the positioning block, one end of the first locking member is connected with one of the two connecting rods;

the second locking member is slideably disposed in the slide groove of the positioning block, a pivot member is formed at one end of the second locking member, and the other end of the second locking member is connected with the other one of the two connecting rods;

the pivot control member is located between the first and second locking members and is pivotally mounted on the pivot member of the second locking member, a guiding block is formed on the pivot control member for cooperating with the first locking member and includes a slant surface, a flat surface, and a control shaft is located beside the guiding block, the pivot control member is provided with a confirmation rod located in a direction of the moveable slide rail;

the control block assembly includes a control block mounted on the movable slide rail and is provided with a guiding surface for cooperating with the control shaft of the pivot control member, the guiding surface pushes the pivot control member to rotate, a pushing block is formed on the control block for pushing the confirmation rod of the control pivot member to move; and the spring is disposed between the first locking member and the positioning block for pushing the first locking member toward the second locking member in response to the control block pushing the control shaft.

2. The interlocking device for a drawer slide as claimed in claim 1, wherein the control block assembly further includes an elastic return member positioned between the control block and the movable slide rail, the control block is provided with a slant guiding surface for cooperating with the control shaft of the pivot control member, the elastic return member allows the control block to be pushed by the control shaft of the pivot control member, producing a return force.

3. The interlocking device for a drawer slide as claimed in claim 2, wherein:

at one end of the moveable slide rail are formed a stopping member and a pivot hole; and the control block assembly further includes a pivot shaft through which the control block is pivotally disposed in the pivot hole of the movable slide rail, and the control block is pushed against the stopping member of the slide rail by the elastic return member.

4. The interlocking device for a drawer slide as claimed in claim 2, wherein a slant surface is formed on a side of the confirmation rod and located in the direction of the movable slide rail, and the pushing block of the control block assembly is opposite the slant surface of the confirmation rod.

5. The interlocking device for a drawer slide as claimed in claim 2, wherein the elastic return member is positioned between a positioning groove of the control block and an inner surface of the movable slide rail.

6. The interlocking device for a drawer slide as claimed in claim 1, wherein:

the fixed slide rail is provided with a receiving seat on a drawer-receiving side thereof for receiving the drawer;

the movable slide rail is movably disposed in the fixed rail and is defined with a receiving groove for receiving the receiving seat; and the positioning block is positioned in the receiving seat of the fixed slide rail and is provided with a slide groove perpendicular to the horizontal direction.

* * * * *